US009321570B2

(12) United States Patent
Kim et al.

(10) Patent No.: US 9,321,570 B2
(45) Date of Patent: Apr. 26, 2016

(54) STOPPER FOR FOOD-BEVERAGE CONTAINER WHICH CONTAINS FUNCTIONAL ADDITIVE

(71) Applicant: DONG-A PRECISION IND. CO., LTD., Bucheon-si, Gyeonggi-do (KR)

(72) Inventors: Hong Ryul Kim, Seoul (KR); Doo Youn Kim, Seoul (KR)

(73) Assignee: DONG-A PRECISION IND. CO., LTD., Bucheon-si (KR)

( * ) Notice: Subject to any disclaimer, the term of this patent is extended or adjusted under 35 U.S.C. 154(b) by 10 days.

(21) Appl. No.: 14/508,765

(22) Filed: Oct. 7, 2014

(65) Prior Publication Data

US 2015/0203260 A1 Jul. 23, 2015

(30) Foreign Application Priority Data

Jan. 22, 2014 (KR) ..... 10-2014-0007775

(51) Int. Cl.
*B65D 51/28* (2006.01)
*B65D 81/20* (2006.01)

(52) U.S. Cl.
CPC ..... *B65D 51/2814* (2013.01); *B65D 81/2053* (2013.01)

(58) Field of Classification Search
CPC ..... Y10S 215/08; B65D 51/2814; B65D 51/2828; B65D 81/32; B65D 2101/0023; B65D 2231/02; B65D 51/22; B65D 51/2821; B65D 51/2842; B65D 5/068; B65D 83/0463; B65D 75/5805; B65D 2575/3227
See application file for complete search history.

(56) References Cited

U.S. PATENT DOCUMENTS

| | | | | |
|---|---|---|---|---|
| 4,965,135 | A * | 10/1990 | Im et al. | 428/412 |
| 6,165,523 | A * | 12/2000 | Story | 426/112 |
| 6,372,270 | B1 * | 4/2002 | Denny | 426/77 |
| 2002/0166792 | A1 * | 11/2002 | Filion et al. | 206/532 |
| 2003/0017236 | A1 * | 1/2003 | Makita et al. | 426/115 |
| 2005/0226964 | A1 * | 10/2005 | Small et al. | 426/115 |
| 2005/0284789 | A1 * | 12/2005 | Carespodi | 206/461 |
| 2009/0255929 | A1 * | 10/2009 | Abercrombie et al. | 220/212 |
| 2011/0049003 | A1 * | 3/2011 | Bellamah et al. | 206/531 |
| 2011/0174642 | A1 * | 7/2011 | Coon | 206/222 |

FOREIGN PATENT DOCUMENTS

KR 10-0840387 B1 6/2008

* cited by examiner

*Primary Examiner* — Viren Thakur
*Assistant Examiner* — Thanh H Nguyen
(74) *Attorney, Agent, or Firm* — Novick, Kim & Lee, PLLC; Jae Youn Kim

(57) ABSTRACT

A stopper for a food or beverage container in which a functional additive is contained. A stopper body is screw-engaged with a container, and includes an opening support at the lower end which indicates the open state of the stopper and an inward flange on the upper end. A pressure vessel includes an outward flange coupled with the stopper body and an open bottom portion. The pressure vessel contains the additive and nitrogen gas, and is compressed by an external force to discharge the additive. A blocking film is coupled to the lower end of the pressure vessel, and is torn by the external force such that the additive is inputted into the container. A protective cap is coupled to the stopper body to protect the pressure vessel, and is separable from the stopper body.

7 Claims, 8 Drawing Sheets

STOPPER FOR FOOD-BEVERAGE CONTAINER WHICH CONTAINS FUNCTIONAL ADDITIVE

CROSS REFERENCE TO RELATED APPLICATION

The present application claims priority from Korean Patent Application Number 10-2014-0007775 filed on Jan. 22, 2014, the entire contents of which are incorporated herein for all purposes by this reference.

BACKGROUND OF THE INVENTION

1. Field of the Invention

The present invention relates to a stopper for a food-beverage container which contains a functional additive. More particularly, the present invention relates to a stopper for a food-beverage container which can contain various foods or beverages therein, in which a functional additive in the shape or powder or liquid is contained and stored inside the container stopper which closes an opening of the container. The container stopper is configured such that a user can mix the additive into food or water by applying a pressure to the container stopper in order to eat or drink the food or water together with the additive. Accordingly, the user can intake various types of foods or beverages, such as a meal substitution food, a health beverage, a baby food, a patient meal or a sport health beverage.

2. Description of Related Art

Various edible foods or beverages are contained in containers. Such a container contains typically includes a container body which has defined therein an accommodation space for contents produced by mixing several ingredients and a stopper which closes the opening of the container body in an sealing or airtight fashion.

Recently, at a point in time where functional beverages appear and are used by consumers, the necessity for a container structure with which different contents can be mixed is on the rise.

Although most beverages are distributed as a mixture, some vitamins such as vitamin C are not only destroyed at a relatively high speed but also the contents thereof are reduced by heat or ultraviolet (UV) radiation or through combination with moisture or water. Therefore, it is preferable to add sensitive vitamins to beverages directly before the beverages are consumed. For the same reason, transparent, semitransparent or moisture permeable containers are not suitable for long-term storage of vitamin beverages.

Accordingly, beverage containers that can be simply handled have been developed. In addition, these containers allow consumers to add sensitive yet active additives by the user just before they consume beverages.

According to the structure of a related-art stopper for a container proposed for such necessity, when the stopper or lid which closes the container in a sealing or airtight fashion is opened, a partition member or an inner stopper that partitions different contents from each other is introduced into the accommodation space inside the container body.

However, the partition member present together with contents within the accommodation space may obstruct the contents from being taken out. In addition, when the contents are colloidal solutions, the partition member may not sink to the bottom, thereby blocking the path through which the contents flow. Furthermore, this structure also has the possibility that the partition member that is introduced into the accommodation space may enter the mouth of users together with the beverage.

Regardless of such problems, a structure with which users can mix a separate additive to basic contents (beverage) themselves was disclosed in Korean Patent No. 10-0840387, titled "CONTAINER STOPPER." As defined the claims of this document, this container stopper includes: a main body disposed at an opening of a container; a plug movably disposed in the opening of the container, the plug having defined therein an inner space in which contents to be injected into the container is contained; a sealing member sealing the inner space of the plug; and at least one cutting part connected to the main body, the cutting part cutting the sealing member in response to the plug being moved. The plug includes a support part connected to the main body and a movable part which is to be opened in the direction such that the inner space faces toward the cutting part. The movable part is connected to the support part such that the movable part can be separated and moved from the support part in response to external force being applied thereto. The sealing member closes the portion of the inner space that is to be opened toward the cutting part.

In the related-art stopper structure configured as above, the additive is mixed into the contents as follows: First, the stopper is removed from the plug, and then a downward pressure is applied to the movable part which is exposed to the outside. Consequently, the upper end of the stopper body cuts and divides the support section in response to the downward pressure, and the plug moves downwards along a plug-fitting part which is fitted into the opening of the container. The central bottom portion of the plug is torn and opened by being pricked by the cutting part, and subsequently the additive flows into the accommodation space of the container.

However, the related-art container stopper has a complicated structure in order to fix the plug at the protruding position. For this, the support section is shaped as a skirt, and a tubular part extends from the upper end of the main body to hold the skirt. More particularly, since the sealing member is torn by the separate cutting part, a large number of parts is required and the structure is complicated, thereby making the assembly process difficult and increasing the fabrication process and cost.

In addition, in the related-art container stopper, the configuration of tearing the sealing member using the separate cutting part not only increases the cost but also makes the input of the additive difficult, thereby decreasing user convenience.

More specifically, health food containers distributed in the market are configured such that a functional solution is contained within the container and a pill-shaped additive is accommodated inside a separate compartment provided in the opening of the container. In this case, a plurality of holes is formed in the bottom of the separate compartment in which the additive is contained such that the functional solution contained within the container can flow out through the holes. With this structure, the functional solution inside the container communicates with the compartment in which the pill-shaped additive is contained. Consequently, although the opening of the container is closed with the stopper, moisture or liquid may contact the pill-shaped additive while being stored and distributed, thereby transforming the additive.

In addition, according to the related-art containers for health foods, the pill-shaped additive contained inside the container opening or the container is stored separately from the functional solution. When such a container stays in a fallen posture for a long time, the functional solution contained within the container may move toward the opening of the container due to, for example, an osmotic pressure, thereby causing oxidation, which is problematic.

The information disclosed in the Background of the Invention section is provided only for better understanding of the background of the invention and should not be taken as an acknowledgment or any form of suggestion that this information forms a prior art that would already be known to a person skilled in the art.

RELATED ART DOCUMENT

Patent Document 1: Korean Patent No. 10-0840387

BRIEF SUMMARY OF THE INVENTION

Various aspects of the present invention provide a stopper for a food or beverage container, in which a pressure vessel which contains an additive in the form of powder, tablets or liquid together with nitrogen gas is disposed inside the stopper on the top of a food or beverage container, such that a user can easily and simply mix the additive into contents within the container, such as beverage, milk, yogurt or water, by tearing the pressure vessel with one touch and subsequently drink or eat the mixture.

Also provided is a stopper for a food or beverage container which has an improved simple structure for inputting an additive contained therein into a food or beverage container, such that the additive in the form of powder, tablets or liquid can be simply mixed into basic contents (a variety of foods or beverages), thereby reducing a fabrication cost and improving assemblability.

Also provided is a stopper for a food or beverage container which contains a functional additive, with which a user can intake a substitute food at a supermarket, a convenient store or a discount store when he or she did not have a meal on time because of the nuclear family phenomenon or a busy work life. In addition, the additive can be manufactured in the form of functional foods according to applications. For example, the functional foods can be specific to patients, body building, general uses and infants.

Also provided is a stopper for a food or beverage container which is coupled to the opening of the container and includes a pressure vessel seated inside the stopper, with an additive being contained within the pressure vessel. The additive is selected from grain powder, green tea powder, coffee powder and the like. A user can tear a blocking film disposed on the pressure vessel by pressing the pressure vessel, whereby the additive mixes into beverage or food stored within the container.

In an aspect of the present invention, provided is a stopper for a food or beverage container that includes: a stopper body screw-engaged with a container, wherein the stopper body includes an opening support at the lower end, the opening support indicating the open state of the stopper, and an inward flange on the upper end; a pressure vessel including an outward flange coupled with the stopper body and an open bottom portion, wherein the pressure vessel contains an additive and nitrogen gas, and wherein the pressure vessel is compressed by an external force to discharge the additive; a blocking film coupled to the lower end of the pressure vessel, wherein the blocking film is torn by the external force such that the additive is inputted into the container; and a protective cap coupled to the stopper body to protect the pressure vessel, the protective cap being separable from the stopper body.

According to an embodiment of the present invention, the pressure vessel may include a pressure bellows which guides the additive such that the additive is completely discharged and imparts a predetermined level of elasticity to the pressure vessel.

The blocking film may include a pressure tearing part which includes polyethylene resin layers disposed on uppermost and lowermost surfaces, nylon resin layers disposed inside the polyethylene resin layers and a polystyrene resin layer disposed between the nylon resin layers.

The pressure tearing part may further include an aluminum coating layer on the outer surface of at least one of the polyethylene resin layers.

The blocking film may include: a multi-stepped annular recess on the central portion of the bottom surface, the annular recess having a pressing portion on the central portion; an annular tearing portion around the annular recess, the annular tearing portion having a non-tearing portion which is not torn by the external force; and a plurality of linear tearing portions disposed around the annular tearing portion and extending radially outward.

The blocking film may include a sealing film on a lower end, the sealing film preventing fine dust from moving toward the pressure vessel from the outside.

The stopper body may have an annular projection on the lower outer circumference, and the protective cap has an annular groove on the lower inner circumference. The annular projection and the annular groove are configured to engage to and disengage from each other.

The additive may have the form of powder, tablets or liquid, the additive being one or a mixture of at least two selected from the group consisting of a variety of vitamins, grain powder, green tea powder, coffee powder, nutritional supplements, mineral, green tea, cacao and juice.

According to the present invention as set forth above, since the additive is contained together with the nitrogen gas within the pressure vessel, it is possible to store the additive for a long time while preventing the additive from oxidizing. A user can simply mix the additive stored in the pressure vessel into a variety of beverages, milk, yogurt, water or the like as required and subsequently drink or eat the mixture.

In addition, according to the present invention as set forth above, the stopper for a food or beverage container is configured such that the blocking film is torn by a pressure. It is therefore possible to preclude the cutting part of the related art which serves to tear the sealing member, thereby reducing a fabrication cost and improving the assemblability of the stopper. It is also possible to prevent an accident from occurring when children use the stopper.

Furthermore, according to the present invention as set forth above, it is possible to simply input and mix the additive into contents within the container by separating the protective cap and pressing the pressure vessel, thereby structurally improving the convenience of the user.

In addition, according to the present invention as set forth above, the stopper for a food and beverage container the user to intake a substitute food at a supermarket, a convenient store or a discount store in the way to work when he or she did not have a meal on time because of the nuclear family phenomenon or a busy work life. The additive can be manufactured in the form of functional foods according to applications which are specific to patients, body building, general uses and infants.

Furthermore, according to the present invention as set forth above, the container stopper also includes the tearing sheet consisting of a plurality of layers. It is therefore possible to prevent a variety of beverages, milk, yogurt, water or the like stored in the container from penetrating into the container stopper or being absorbed to the container stopper by an osmotic pressure or the like, thereby preventing the additive from oxidizing.

The methods and apparatuses of the present invention have other features and advantages which will be apparent from, or are set forth in greater detail in the accompanying drawings, which are incorporated herein, and in the following Detailed Description of the Invention, which together serve to explain certain principles of the present invention.

DETAILED DESCRIPTION OF THE INVENTION

Figure 1:
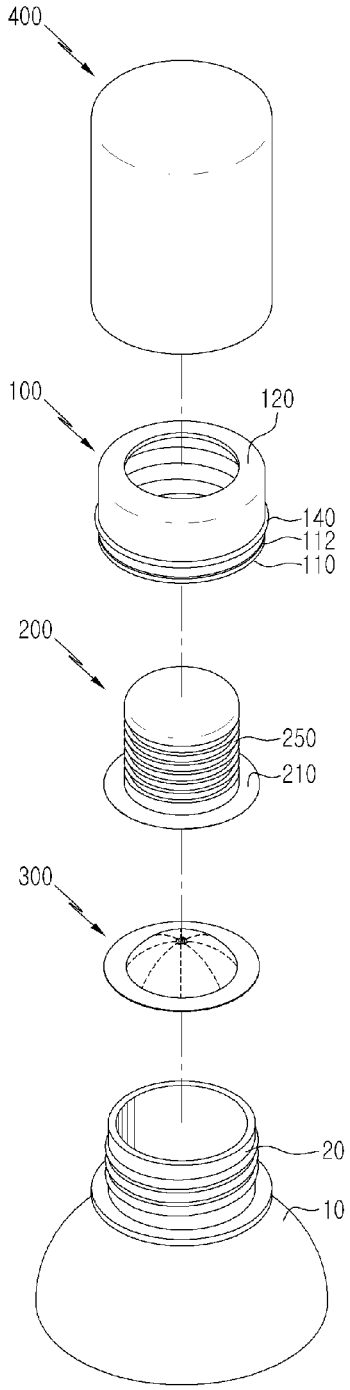
FIG. 1 is an exploded perspective view showing a stopper for a food or beverage container that contains a functional additive according to an exemplary embodiment of the invention.

Reference will now be made in detail to the present invention, embodiments of which are illustrated in the accompanying drawings. Reference should be made to the drawings, in which the same reference numerals and signs may be used throughout the different drawings to designate the same or similar components. In the following description of the present invention, detailed descriptions of known functions and components incorporated herein will be omitted in the case that the subject matter of the present invention is rendered unclear thereby.

It will be understood that, although terms "first," "second," "A," "B," "(a)," "(b)," etc. may be used herein to describe various elements, these terms are only used to distinguish one element from another element. The substance, sequence or order of these elements are not limited by these terms. It will be understood that when an element is referred to as being "connected to" or "coupled to" another element, not only can it be "directly connected" or "coupled to" the other element, but also can it be "indirectly connected or coupled to" the other element via an "intervening" element.

Figure 2:
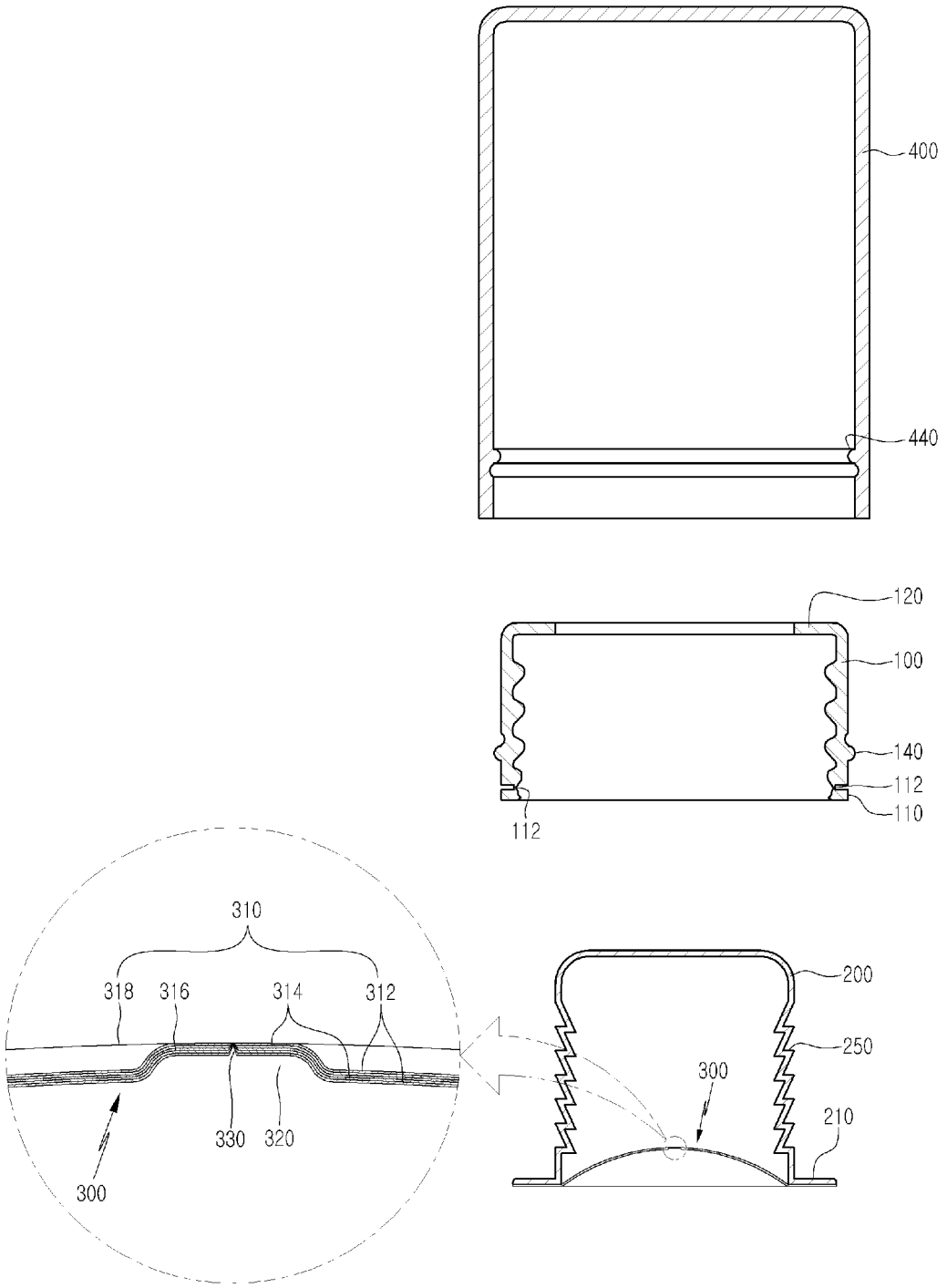
FIG. 2 is an exploded cross-sectional view showing the stopper for a food or beverage container that contains a functional additive according to an exemplary embodiment of the invention.
Figure 3A:
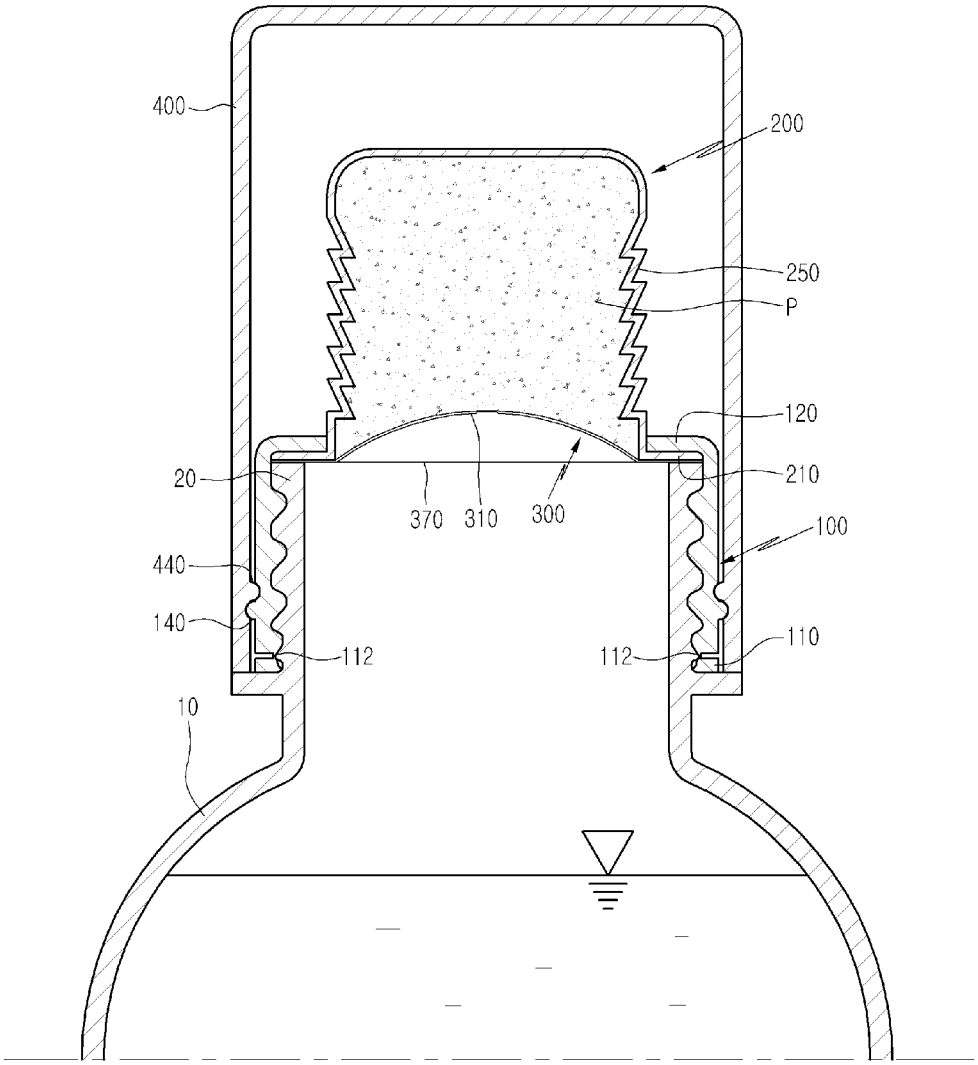
FIG. 3A and FIG. 3B are assembled cross-sectional views showing the stopper for a food or beverage container that contains a functional additive according to an exemplary embodiment of the invention.
Figure 3B:
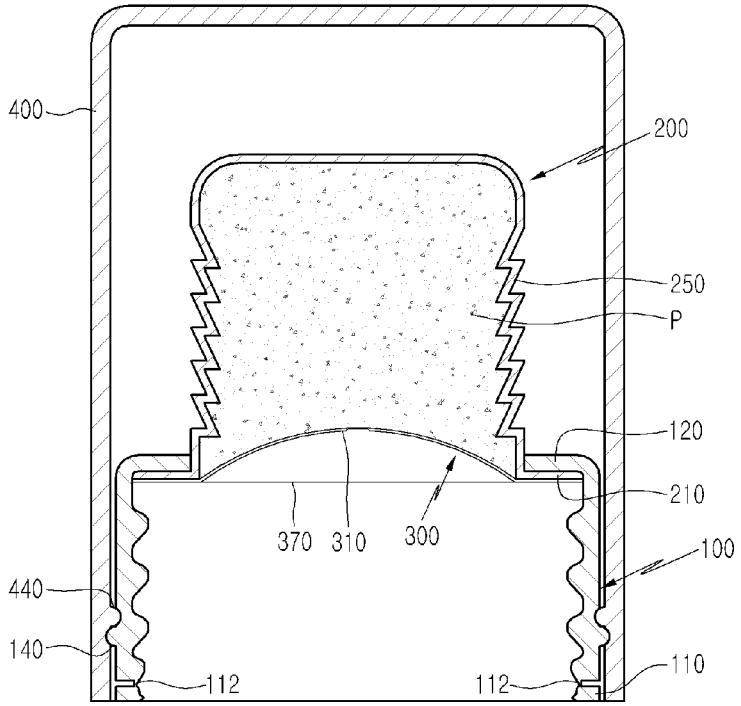
Figure 4:
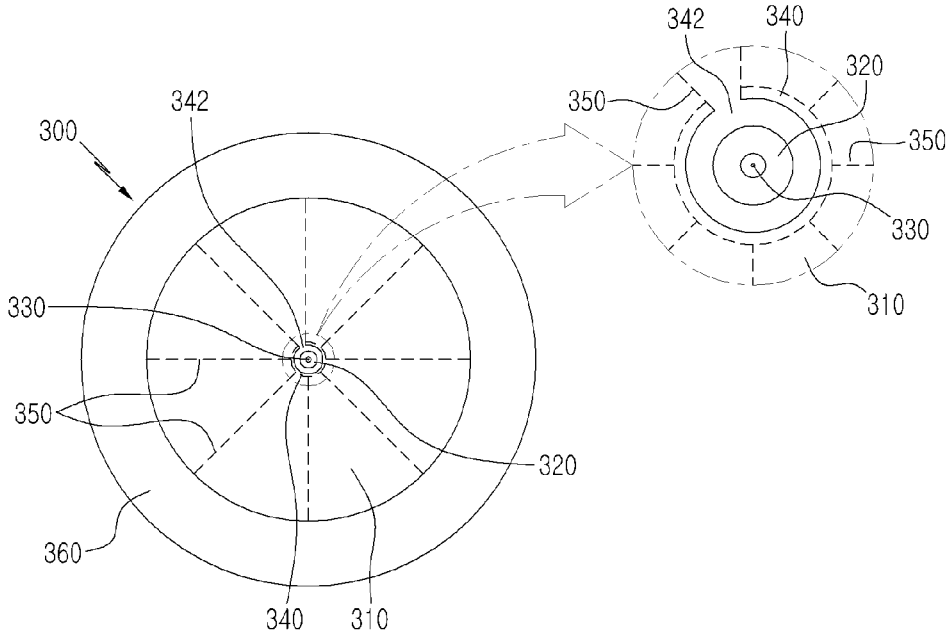
FIG. 4 is a top plan view showing a blocking film of the stopper for a food or beverage container that contains a functional additive according to an exemplary embodiment of the invention.
Figure 5:
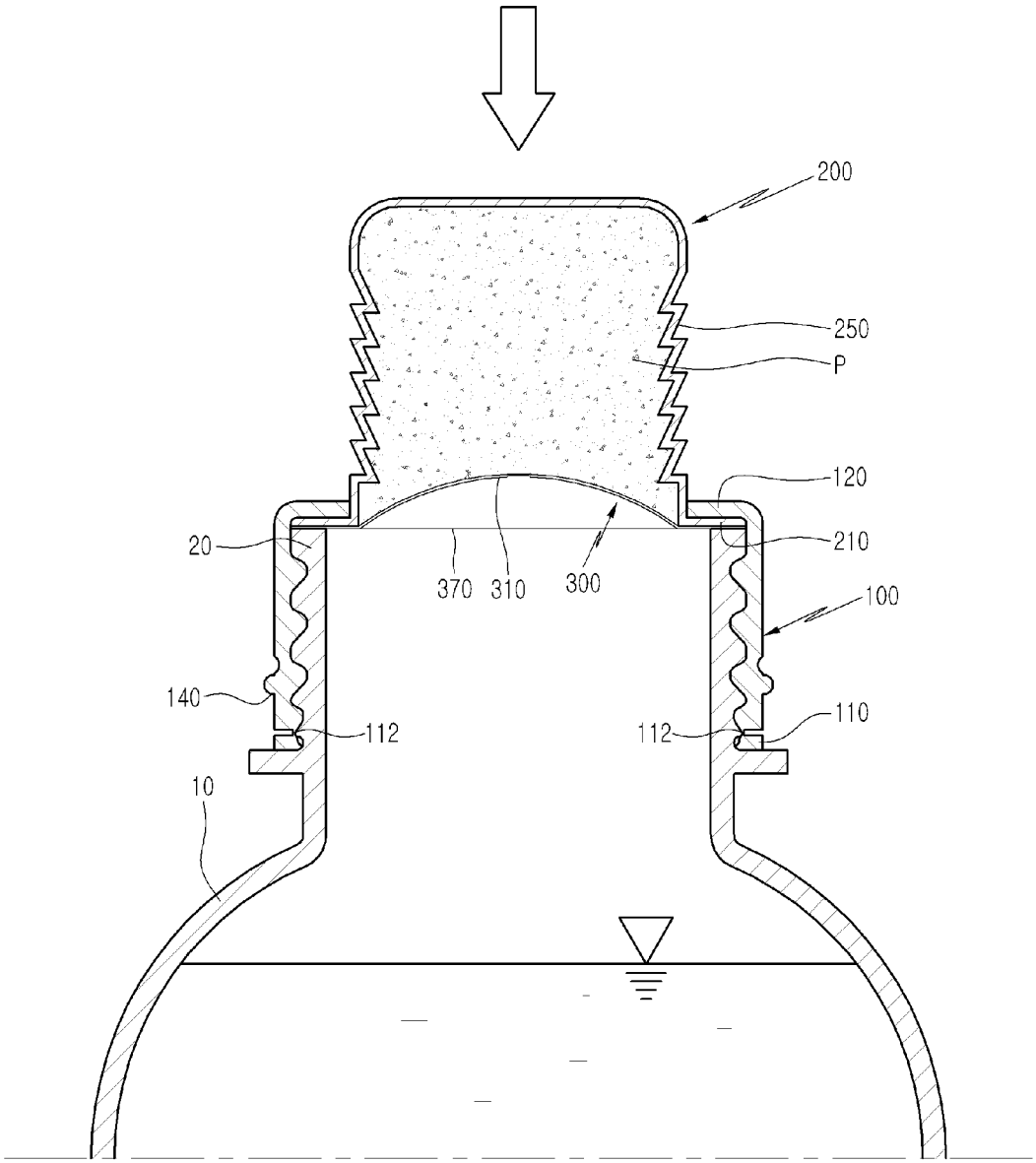
FIG. 5 and FIG. 6 are cross-sectional views showing the state of use and operation of the stopper for a food or beverage container that contains a functional additive according to an exemplary embodiment of the invention.
Figure 6:
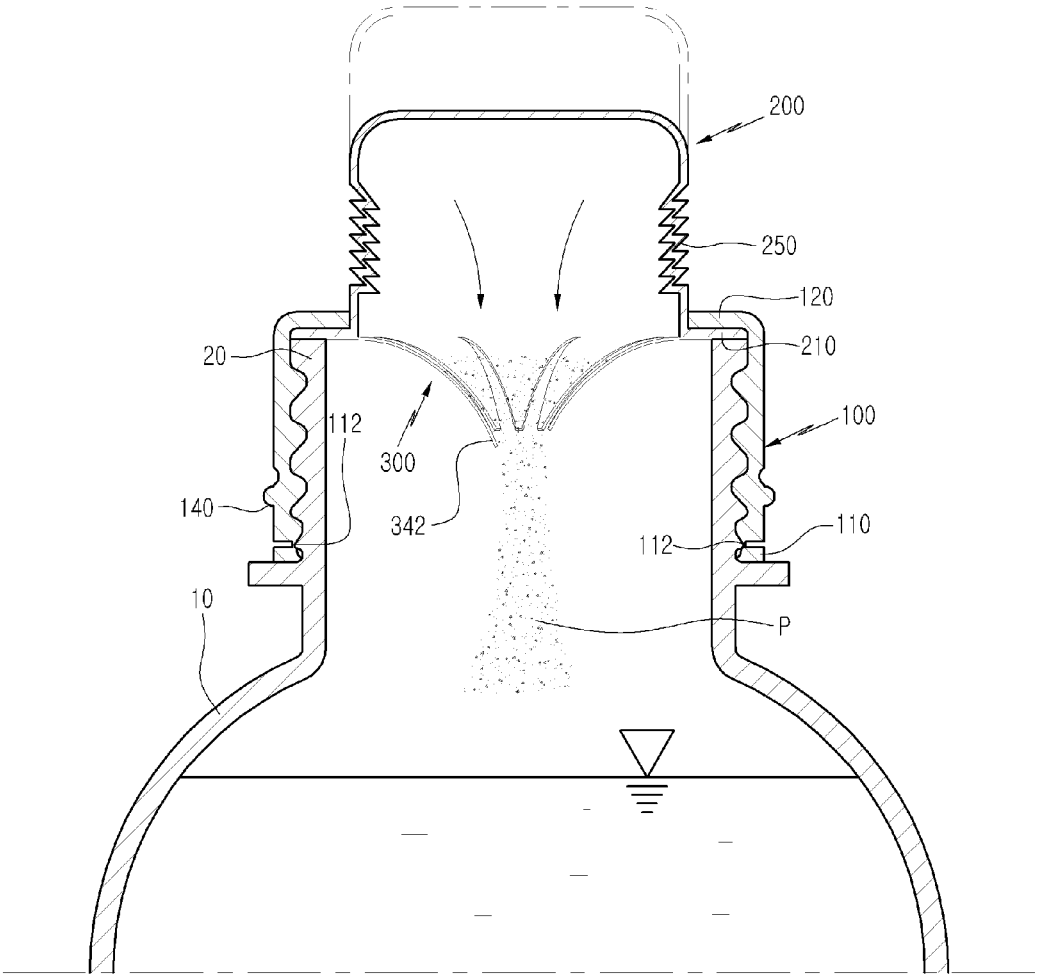
Figure 7A:
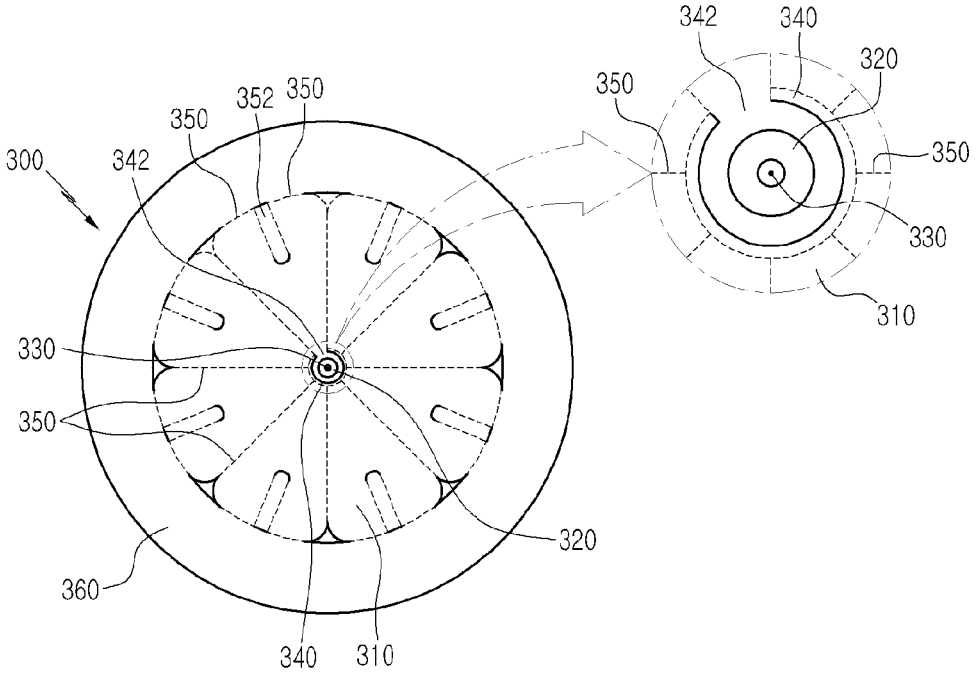
FIG. 7A, FIG. 7B, FIG. 8A and FIG. 8B show another embodiment of the blocking film of the stopper for a food or beverage container that contains a functional additive according to the invention.
Figure 7B:
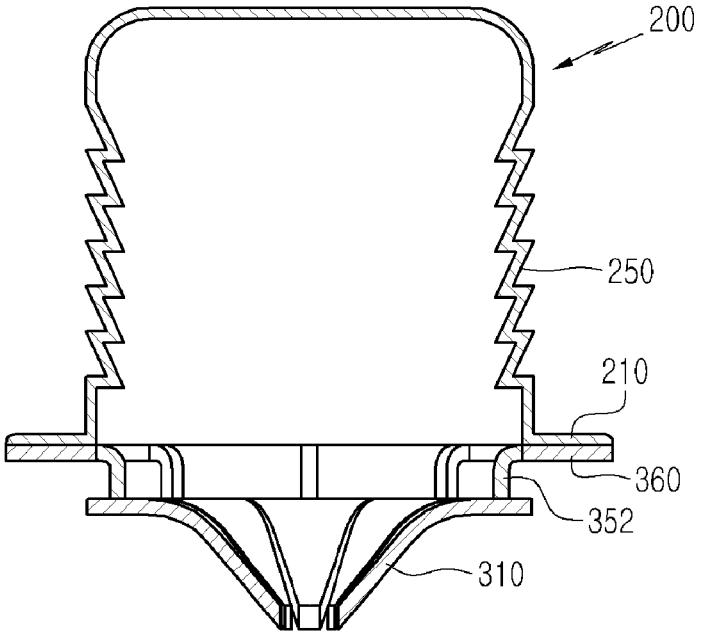

FIG. 1 is an exploded perspective view showing a stopper for a food or beverage container that contains a functional additive according to an exemplary embodiment of the invention, FIG. 2 is an exploded cross-sectional view showing the stopper for a food or beverage container that contains a functional additive according to an exemplary embodiment of the invention, FIG. 3A and FIG. 3B are assembled cross-sectional views showing the stopper for a food or beverage container that contains a functional additive according to an exemplary embodiment of the invention, FIG. 4 is a top plan view showing a blocking film of the stopper for a food or beverage container that contains a functional additive according to an exemplary embodiment of the invention, FIG. 5 and FIG. 6 are cross-sectional views showing the state of use and operation of the stopper for a food or beverage container that contains a functional additive according to an exemplary embodiment of the invention, and FIG. 7A, FIG. 7B, FIG. 8A and FIG. 8B show another embodiment of the blocking film of the stopper for a food or beverage container that contains a functional additive according to the invention.

As shown in these figures, the stopper for a food or beverage container according to an exemplary embodiment of the present invention has an additive accommodation structure which contains an additive P and allows the additive P to be loaded into a container 10. The stopper for a food or beverage container includes a stopper body 100 which is assembled to an opening 20 of the container 10 by screw engagement. A pressure vessel 200 is engaged with the stopper body 100 such that the former can be separated from the latter, and the additive and nitrogen gas are loaded into the pressure vessel 200. A blocking film 300 prevents the additive P and the nitrogen gas from leaking out, and supplies the additive P and the nitrogen gas contained in the pressure vessel 200 into the container 10. A protective cap 400 is engaged with the stopper body 100 to protect the pressure vessel 200.

The stopper for a food or beverage container according to an exemplary embodiment of the invention has a simple structure of four parts, including the stopper body 100, the pressure vessel 200, the blocking film 300 and the protective cap 400. Since the related-art cutting part which cuts or tears the sealing member is not required, the simple structure can improve ease of assembly while reducing fabrication cost. In addition, it is possible to prevent accidents that would otherwise occur when children use conventional stoppers for food and beverage containers.

In addition, as is known in the art, the container 10 according to the present invention is made of a synthetic resin or implemented as a glass bottle. The opening 20 through which contents can be input or output is provided on the top of the container 10, and threads are formed on the outer circumference of the opening 20.

The stopper body 100 is meshed with the opening 20 of the container 10 in a sealing or airtight fashion. An opening support 110 is provided on the bottom of the stopper body 100, and an inward flange 120 is provided on the top of the stopper body 100.

The stopper body 100 is provided with a safety device which prevents the blocking film from being damaged in order to prevent the additive P from leaking from the stopper body 100 when container stopper is opened. The safety device can be implemented as a typical shaft system.

The stopper body 100 is made of a synthetic resin such as polyethylene (PE) or polypropylene (PP). A female thread, which meshes with a male thread of the container 10, is formed on the inner circumference of the stopper body 100.

In addition, the opening support 110 is formed integrally with the stopper body 100, and indicates the open state of the container 10. The opening support 110 is connected to the bottom of the stopper body 100 via a plurality of cutting lines 112.

In addition, the inward flange 120 is a component of the stopper body 100 that is formed integrally with the stopper body 100. The inward flange 120 is configured such that the pressure vessel 200 is fitted into the inward flange 120.

The pressure vessel 200 is made of a synthetic resin such as PE or PP. The pressure vessel 200 protrudes upward in the position in which it is fitted into the inward flange 120. An outward flange 210 is provided on the bottom of the pressure vessel 200. The outward flange 210 is fitted between the opening of the container 10 and the inward flange 120 of the stopper body 100. The additive P and the nitrogen gas are contained within the pressure vessel 200 which is open at the bottom.

In this pressure vessel 200, the additive P in the form of powder, tablets or liquid is contained. The additive P can be one selected from among, but not limited to, a variety of vitamins, grain powder, green tea powder, coffee powder, nutritional supplements, mineral, green tea, cacao and juice.

In addition to the additive P, the nitrogen gas is contained in the pressure vessel 200. The nitrogen gas contained in the pressure vessel 200 serves to expand the pressure vessel 200 while allowing the additive P to better maintain its freshness.

When the pressure vessel 200 containing the additive P is inputted into a refrigerator, the nitrogen gas serves to prevent dew condensation due to the difference in temperature between the inside and the outside of the pressure vessel 200. Since the condensation temperature of nitrogen is very low, no dew condensation occurs in the powder filled with the nitrogen gas. Since the nitrogen gas is contained in the enclosed space of the pressure vessel 200, it is possible to prevent the additive P inside the pressure vessel 200 from oxidizing.

The pressure vessel 200 according to the present invention further has a pressure bellows 250.

The pressure bellows 250 is a component that allows the pressure vessel 200 to be more easily compressed downward when an external pressure is applied to the pressure vessel 200. The pressure bellows 250 also guides the additive P from being completely discharged from the pressure vessel 200.

The pressure bellows 250 imparts a preset level of elasticity to the pressure vessel 200. The pressure bellows 250 is pleated into the pressure vessel 200 such that the additive P stored within the pressure vessel 200 is completely discharged without residing between the pleats of the pressure bellows 250 when the pressure bellows 250 is pressed. The pressure bellows 250 also has a taper portion that is inclined downward such that the additive P residing on the pressure bellows 250 can be discharged into the container 10.

The pressure vessel 200 having the above-described configuration according to an exemplary embodiment of the invention can be enclosed with the blocking film 300, more particularly, a tearing sheet of the blocking film 300 which includes PE resin layers 312, nylon resin layers 314, a polystyrene (PS) resin layer 316 and an Al coating layer 318 which are sequentially stacked on each other. The Al coating layer 318 is selectively provided according to the type of the additive P stored in the pressure vessel 200.

The blocking film 300 includes a convex pressure tearing part 310 which protrudes upward. The pressure tearing part 310 is attached to the outer flange 210 of the pressure vessel 200 to close the pressure vessel 200 in a sealing and airtight fashion in order to prevent the additive P and the nitrogen gas stored within the pressure vessel 200 from undesirably leaking. The pressure tearing part 310 also allows the additive P to enter the container 10 as required by a user.

The pressure tearing part 310 protrudes upward from the central portion of the blocking film 300 to have a convex shape like the pressure vessel 200. The pressure tearing part 310 is implemented as a tearing sheet composed of a multiplicity of layers such that the pressure tearing part 310 can be easily torn by pressure inside the pressure vessel 200 when a preset amount of pressure is applied to the pressure vessel 200.

The tearing sheet that forms the pressure tearing part 310 according to an exemplary embodiment of the invention includes the PE resin layers 312, the nylon resin layers 314, the PS resin layer 316 and the Al coating layer 318 which are sequentially stacked on each other. The Al coating layer 318 is selectively provided according to the type of the additive P stored in the pressure vessel 200.

Specifically, the PE resin layers 312 are disposed on the uppermost and lowermost surfaces of the pressure tearing part 310, the nylon resin layers 314 are disposed inside the PE resin layer 312, and the PS resin layer 316 is disposed between the nylon resin layers 314. Describing this structure from the uppermost layer, the PE resin layer 312, the nylon resin layer 314, the PS resin layer 316, the nylon resin layer 314 and the PE resin layer 312 are sequentially stacked on one another.

In addition, the Al coating layer 318 is classified according to the amount or weight of the stored additive P or the size of particles of the additive P. The Al coating layer 318 can coat both the surface of the PE resin layers 312 on the uppermost and lowermost surfaces in order to enhance the strength of the pressure tearing part 310 when the weight of the additive P exceeds the level that the pressure tearing part 310 can support. Specifically, the Al coating layer 318 can be disposed on at least one of the uppermost PE resin layer 312 and the lowermost PE resin layer 312.

The pressure tearing part 310 having the above-described configuration according to an exemplary embodiment of the invention includes a multi-stepped annular recess 320 in a central portion of the bottom, the annular recess 320 having a pressing portion 330 on the central portion, an annular tearing portion 340 around the annular recess 320, the annular tearing portion 340 having a non-tearing portion 342, and a plurality of linear tearing portions 350 disposed around the annular tearing portion 340 and extending radially outward.

When the pressure vessel 200 is pressed, a pressure generated inside the pressure vessel 200 is transferred to the pressure tearing part 310 of the blocking film 300. Consequently, the annular tearing portion 340 and the linear tearing portions 350 of the pressure tearing part 310 are easily torn by the pressure applied thereto.

As the annular tearing portion 340 and the linear tearing portions 350 are torn, the additive P contained in the pressure vessel 200 is inputted into the container 10.

Since the non-tearing portion 342 formed on one region of the annular tearing portion 340 is not torn by the external pressure, the annular tearing portion 340 remains suspended from the blocking film 300 without dropping downward when the annular tearing portion 340 is torn.

That is, the blocking film 300 according to an exemplary embodiment of the invention disposed on the pressure vessel 200 has the circular shape and is configured such that the non-tearing portion 342 prevents the annular tearing portion 340 from dropping into the contents within the container 10 when the pressure tearing part 310 made of the plurality of resin layers is torn by an external pressure.

The blocking film 300 according to an exemplary embodiment of the invention is preferably provided with a coupling flange 360 which is attached to the outward flange of the pressure vessel 200, and by means of which the blocking film 300 is coupled with the pressure vessel 200. However, this is not intended to be limiting.

In addition, the shape of the blocking film 300 according to an exemplary embodiment of the invention can be selected from among not only a variety of shapes such as a polygonal shape (such as a triangular shape), a circular shape an elliptical shape, but also a variety of patterns such as a petal-shaped pattern and a leaf-shape pattern.

In particular, when the blocking film 300 has a patterned shape, the linear tearing portions 350 can be also formed on the boundaries to the coupling flange 360 to maximize the area torn by a pressure generated when the pressure vessel 200 is operated, thereby accelerating the input of the additive P while preventing the additive P from residing within the pressure vessel 200.

It is preferred that connecting sheets 352 are formed integrally with the portions of the linear tearing portions 350 which are formed on the boundaries to the coupling flange 360 in order to prevent the pressure tearing part 310 from being separated from the coupling flange 360. However, this is not intended to be limiting.

Figure 8A:
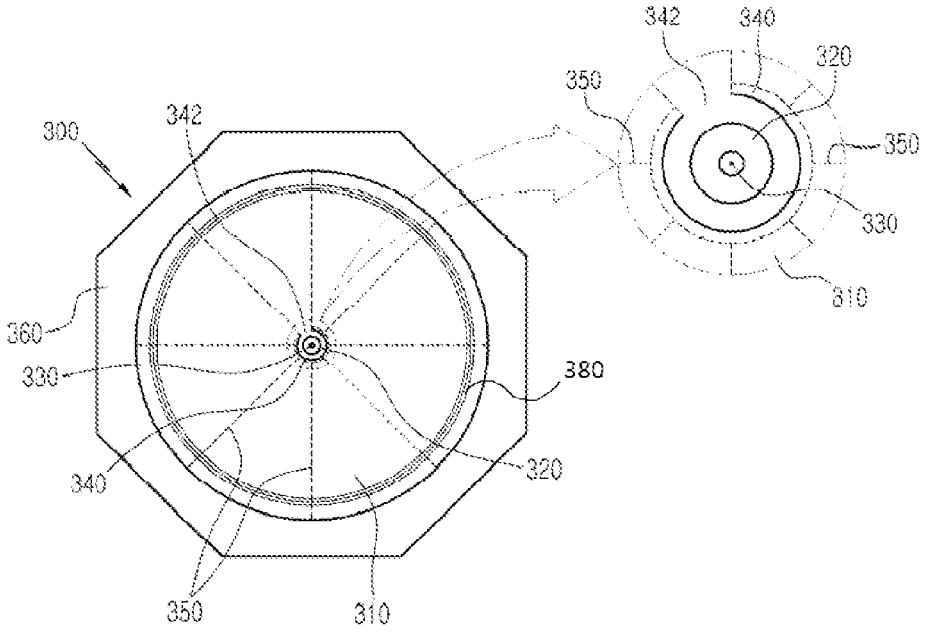
Figure 8B:
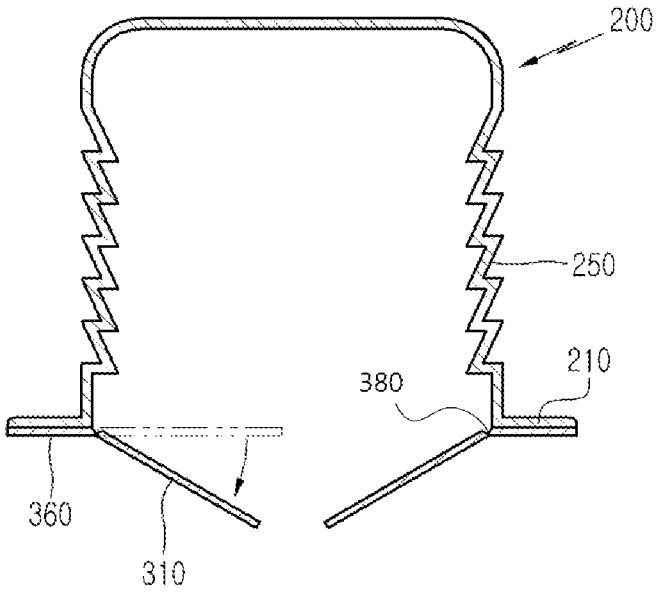

In addition, as shown in FIG. 8A and FIG. 8B, the blocking film 300 according to an exemplary embodiment of the invention has an overall shape which has 8 to 16 sides (octahedron to hexadecagon), and the pressure tearing part 310 consists of eight to 16 triangular areas. The pressing portion 330 is formed on the central portion of the pressure tearing part 310, and the annular tearing portions 340 connect the pressing portion 330 to the vertices of the triangular areas of the pressure tearing part 310. The pressure tearing part 310 has a V-shaped sagging-causing recess 380 at a position adjacent to the coupling flange 360, such that the pressure tearing part 310 more rapidly sags downwards when the pressure vessel 200 operates.

A sealing film 370 is further, provided on the lower end of the blocking film 300. The sealing film 370 is fabricated separately from the container 10. When fine dust or the like is produced while the container stopper according to the invention is being stored and delivered, the sealing film 370 can prevent the dust from entering the pressure vessel 200. When the container stopper is coupled to the container 10, the sealing film 370 can be easily detached.

The sealing film 370 is attached to the coupling flange 360 of the blocking film 300 or the outward flange 210 of the pressure vessel 200 by a method such as bonding or fusion, thereby completely enclosing the inside of the container stopper.

The protective cap 400 is coupled to the stopper body 100 such that the former can be separated from the latter in order to protect the pressure vessel 200. The protective cap 400 prevents either the pressure vessel 200 or the blocking film 300 on the pressure vessel 200 from being damaged while the container stopper according to the invention is being stored or delivered. The protective cap 400 can be made of a synthetic resin such as a PE resin or a PP resin, or can have a multilayer structure of a plurality of resin layers as in the tearing sheet.

In addition, an annular projection 140 is formed on the lower outer circumference of the stopper body 100, and an annular groove 440 is formed on the lower inner circumference of the protective cap 400. The annular projection 140 can engage with and disengage from the annular groove 440.

As described above, the container stopper according to the invention has a simple structure including the stopper body 100, the pressure vessel 200, the blocking film 300 and the protective cap 400, in which the blocking film 300 is torn by a pressure. It is therefore possible to preclude the cutting part of the related art which serves to tear the sealing member. Accordingly, the simple structure of the container stopper can reduce the number of the process steps and the number of the components, and the container stopper can be simply assembled, thereby reducing a fabrication cost.

In addition, in the use of the container stopper, when the additive P is mixed into the contents contained in the container 10, the protective cap 400 according to the invention can act as a cup which contains a preset amount of the mixed contents so that the user can more conveniently drink or eat the mixed contents.

A description will be given below of the overall operation of the container stopper according to the invention having the above-described configuration.

First, at ordinary times, for example, during distribution or storage before the additive P is inputted, the stopper body 100 remains assembled to the opening 20 of the container 10 in a sealing and airtight fashion, the pressure vessel 200 remains assembled to the stopper body 100 10 in a sealing and airtight fashion, and the opening support 110 remains attached to the stopper body 100.

In addition, at ordinary times, the blocking film 300 remains sealed to the outward flange 210 of the pressure vessel 200, the additive P remains contained in the pressure vessel 200, and the protective cap 400 remains coupled to the stopper body 100. Consequently, the pressure vessel 200 is protected by the protective cap 400, and the pressure tearing part 310 of the blocking film 300 stays in the state in which it is prevented from being torn.

That is, at ordinary times, the additive P contained in the pressure vessel 200 is prevented from being discharged since it remains blocked by the blocking film 300.

Afterwards, when the user decouples the protective cap 400 from the stopper body 100, the pressure vessel 200 can be pressed. When a pressure is applied onto the top portion of the pressure vessel 200 with the protective cap 400 being separated therefrom, the pressure vessel 200 is compressed, thereby generating a pressure inside the pressure vessel 200.

The pressure generated inside the pressure vessel 200 is transferred to the pressure tearing part 310 of the blocking film 300. As shown in FIG. 5 and FIG. 6, the annular tearing portion 340 and the linear tearing portions 350 of the pressure tearing part 310 are easily torn by the pressure applied thereto. Consequently, the additive P contained in the pressure vessel 200 is discharged downwards and inputted into the container 10, and then is mixed into the basic contents such as a variety of beverages or water contained within the container 10. The user can shake the container 10 to help the additive P mix into the contents, and then drink, eat or use the mixture of the additive P and the contents.

Therefore, the stopper for a food or beverage container according to the invention has an advantage in that the user can simply mix the additive P, which is contained and stored in the pressure vessel 200, into the basic contents within the container 10 and subsequently drink or eat the mixed beverage or food.

In addition, the container stopper according to the invention has a simple structure including the stopper body 100, the pressure vessel 200, the blocking film 300 and the protective cap 400, in which the blocking film 300 can be torn by a pressure. It is therefore possible to preclude the cutting part of the related art which serves to tear the sealing member, thereby reducing a fabrication cost and improving assemblability.

Furthermore, in the container stopper according to the invention, it is possible to simply input and mix the additive P into the contents within the container 10 by separating the protective cap 400 and pressing the pressure vessel 200. In this fashion, the structure of the container stopper can improve the convenience of the user.

In addition, the stopper for a food or beverage container which contains a functional additive allows the user to intake a substitute food at a supermarket, a convenient store or a discount store in the way to work when he or she did not have a meal on time because of the nuclear family phenomenon or a busy work life.

Although all of the elements of the foregoing embodiment of the invention have been described as being assembled into and operating as one unit, the invention is not limited thereto. All of those elements can be selectively coupled together and operate as one unit without departing from the principle of the invention.

It will be understood that the terms "comprise", "include", and "have", used herein specify the presence of stated elements but do not preclude the presence or addition of any other elements unless explicitly noted. Unless otherwise defined, all terms including technical and scientific terms used herein have the same meaning as commonly understood by a skilled person in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The foregoing descriptions and the accompanying drawings have been presented in order to explain the certain principles of the present invention. A person skilled in the art to which the invention relates can make many modifications and variations by combining, dividing, substituting for or changing elements without departing from the principle of the invention. The foregoing embodiments disclosed herein shall be interpreted as illustrative only not as limitative of the principle and scope of the invention. It should be understood that the scope of the invention shall be defined by the appended Claims and all of their equivalents fall within the scope of the invention.

What is claimed is:

1. A stopper for a food or beverage container, the stopper comprising:

a stopper body screw-engaged with a container, wherein the stopper body comprises an opening support at a lower end, the opening support indicating an open state of the stopper, and an inward flange on an upper end;

a pressure vessel comprising an outward flange coupled with the stopper body and an open bottom portion, wherein the pressure vessel contains an additive that is ingestible and nitrogen gas, and wherein the pressure vessel is compressible by an external force to discharge the additive;

a blocking film coupled to a lower end of the pressure vessel, wherein the blocking film is tearable by the external force such that the additive is inputted into the container; and a protective cap coupled to the stopper body to protect the pressure vessel, the protective cap being separable from the stopper body, wherein the blocking film comprises a pressure tearing part which comprises polyethylene resin layers disposed on uppermost and lowermost surfaces, nylon resin layers disposed inside the polyethylene resin layers and a polystyrene resin layer disposed between the nylon resin layers.

2. The stopper according to claim 1, wherein the pressure vessel comprises a pressure bellows which guides the additive such that the additive is completely discharged and imparts a level of elasticity to the pressure vessel.

3. The stopper according to claim 1, wherein the pressure tearing part further comprises an aluminum coating layer on an outer surface of at least one of the two polyethylene resin layers.

4. A stopper for a food or beverage container, the stopper comprising:

a stopper body screw-engaged with a container, wherein the stopper body comprises an opening support at a lower end, the opening support indicating an open state of the stopper, and an inward flange on an upper end;

a pressure vessel comprising an outward flange coupled with the stopper body and an open bottom portion, wherein the pressure vessel contains an additive that is ingestible and nitrogen gas, and wherein the pressure vessel is compressible by an external force to discharge the additive;

a blocking film coupled to a lower end of the pressure vessel, wherein the blocking film is tearable by the external force such that the additive is inputted into the container; and a protective cap coupled to the stopper body to protect the pressure vessel, the protective cap being separable from the stopper body, wherein the blocking film comprises:

a multi-stepped annular recess on a central portion of a bottom surface, the annular recess comprising a pressing portion on the central portion;

an annular tearing portion disposed around the annular recess and configured to be torn off when pressure is applied to the pressing portion, the annular tearing portion having a non-tearing portion which is configured to be not torn when pressure is applied to the pressing portion;

a plurality of linear tearing portions disposed around the annular tearing portion, configured to be torn off when pressure is applied to the pressing portion, and extending radially outward; and wherein the blocking film comprises a pressure tearing part which comprises polyethylene resin layers disposed on uppermost and lowermost surfaces, nylon resin layers disposed inside the polyethylene layers and a polystyrene resin layer disposed between the nylon resin layers.

5. The stopper according to claim 1, wherein the blocking film comprises a sealing film on a lower end, the sealing film preventing fine dust from moving toward the pressure vessel from an outside.

6. The stopper according to claim 1, wherein the stopper body has an annular projection on a lower outer circumference, and the protective cap has an annular groove on a lower inner circumference, wherein the annular projection and the annular groove are configured to engage to and disengage from each other.

7. The stopper according to claim 1, wherein the additive has a form of powder, tablets or liquid, the additive being one or a mixture of at least two selected from the group consisting of a variety of vitamins, grain powder, green tea powder, coffee powder, nutritional supplements, mineral, green tea, cacao and juice.

* * * * *